United States Patent [19]

Evans et al.

[11] Patent Number: 4,866,029

[45] Date of Patent: Sep. 12, 1989

[54] ARYLIDENE PYRAZOLONE DYE-DONOR ELEMENT FOR THERMAL DYE TRANSFER

[75] Inventors: Steven Evans, Rochester; Helmut Weber, Webster, both of N.Y.

[73] Assignee: Eastman Kodak Company, Rochester, N.Y.

[21] Appl. No.: 303,866

[22] Filed: Jan. 30, 1989

Related U.S. Application Data

[63] Continuation-in-part of Ser. No. 168,840, Mar. 16, 1988.

[51] Int. Cl.[4] ..... B41M 5/035; B41M 5/26

[52] U.S. Cl. ..... 503/227; 8/471; 428/195; 428/480; 428/913; 428/914

[58] Field of Search ..... 8/471; 428/195, 480, 428/913, 914; 503/227

[56] References Cited

U.S. PATENT DOCUMENTS 4,701,439 10/1987 Weaver ..... 503/227

FOREIGN PATENT DOCUMENTS 59-78895 5/1984 Japan ..... 503/227

*Primary Examiner*—Bruce H. Hess

*Attorney, Agent, or Firm*—Harold E. Cole

[57] ABSTRACT

A dye-donor element for thermal dye transfer comprises a support having thereon a dye dispersed in a polymeric binder, the dye having the formula:

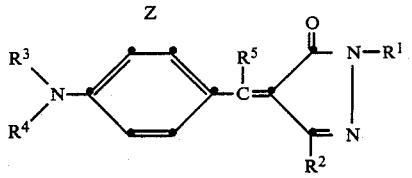

wherein $R^1$ represents a substituted or unsubstituted alkyl group having from 1 to about 10 carbon atoms; a cycloalkyl group having from about 5 to about 7 carbon atoms or an aryl group having from about 6 to about 10 carbon atoms;

$R^2$ represents a substituted or unsubstituted alkoxy group having from 1 to about 10 carbon atoms; a substituted or unsubstituted aryloxy group having from about 6 to about 10 carbon atoms; $NHR^6$; $NR^6R^7$ or the atoms necessary to complete a 6-membered ring fused to the benzene ring;

$R^3$ and $R^4$ each represents $R^1$; or $R^3$ and $R^4$ can be joined together to form, along with the nitrogen to which they are attached, a 5- or 6-membered heterocyclic ring;

$R^5$ represents hydrogen; halogen; carbamoyl; alkoxycarbonyl; acyl; a substituted or unsubstituted alkyl or alkoxy group having from 1 to about carbon atoms; a cycloalkyl group having from about 5 to about 7 carbon atoms; an aryl group having from about 6 to about 10 carbon atoms; or a dialkylamino group;

$R^6$ and $R^7$ each independently represents a substituted or unsubstituted alkyl group having from 1 to about 10 carbon atoms; a cycloalkyl group having from about 5 to about 7 carbon atoms or an aryl group having from about 6 to about 10 carbon atoms; or $R^6$ and $R^7$ may be joined together to form, along with the nitrogen to which they are attached, a 5- or 6-membered heterocyclic ring; and Z represents hydrogen or the atoms necessary to complete a 5- or 6-membered ring.

20 Claims, No Drawings

ARYLIDENE PYRAZOLONE DYE-DONOR ELEMENT FOR THERMAL DYE TRANSFER

This application is a continuation-inpart of U.S. Serial No. 168,840, filed March 16, 1988.

This invention relates to dye-donor elements used in thermal dye transfers which have good hue and dye stability.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electronic signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

A problem has existed with the use of certain dyes in dye-donor elements for thermal dye transfer printing. Many of the dyes proposed for use do not have adequate stability to light. Others do not have good time. It would be desirable to provide dyes which have good light stability and have improved hues.

JP 59/78895 and U.S. Pat. No. 4,701,439 relate to arylidene yellow dyes used in a thermal transfer sheet. There is a problem with these dyes, however, with their stability to light. There is also another problem in that some of these yellow dyes cause degradation of a cyan dye when both are present in the same color patch, such as green or neutral. It would be desirable to provide arylidene dyes which have improved hue and stability to light and heat and which would not cause degradation of other dyes.

Substantial improvements in light stability and hues are achieved in accordance with this invention which comprises a dye-donor element for thermal dye transfer comprising a support having thereon a dye dispersed in a polymeric binder, the dye having the formula:

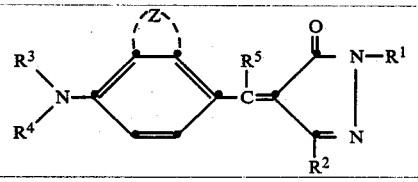

wherein $R^1$ represents a substituted or unsubstituted alkyl group having from 1 to about 10 carbon atoms, such as methyl, ethyl, propyl, isopropyl, butyl, pentyl, hexyl, methoxyethyl, benzyl, 2-methanesulfonamidoethyl, 2-hydroxyethyl, 2-cyanoethyl, methoxycarbonylmethyl, etc.; a cycloalkyl group having from about 5 to about 7 carbon atoms, such as cyclohexyl, cyclopentyl, etc.; or an aryl group having from about 6 to about 10 carbon atoms, such as phenyl, pyridyl, naphthyl, p-tolyl, p-chlorophenyl, or m-(N-methyl sulfamoyl)phenyl;

$R^2$ represents a substituted or unsubstituted alkoxy group having from 1 to about 10 carbon atoms, such as methoxy, ethoxy, methoxyethoxy or 2-cyanoethoxy; a substituted or unsubstituted aryloxy group having from about 6 to about 10 carbon atoms, such as phenoxy; m-chlorophenoxy; or naphtoxy; $NHR^6$; $NR^6R^7$ or the atoms necessary to complete a 6-membered ring fused to the benzene ring, such as O, $CH_2$, S, $NR^6$, etc.;

$R^3$ and $R^4$ each represents $R^1$; or $R^3$ and $R^4$ can be joined together to form, along with the nitrogen to which they are attached, a 5- or 6-membered heterocyclic ring, such as a pyrrolidine or morpholine ring;

$R^5$ represents hydrogen; halogen, such as chlorine, bromine, or fluorine; carbamoyl, such as N,N-dimethylcarbamoyl; alkoxycarbonyl, such as ethoxycarbonyl or methoxyethoxycarbonyl, acyl, such as acetyl or benzoyl; a substituted or unsubstituted alkyl or alkoxy group having from 1 to about 10 carbon atoms, such as methyl, ethyl, propyl, isopropyl, butyl, pentyl, hexyl, methoxyethyl, benzyl, methoxy, ethoxy, 2-methanesulfonamidoethyl, 2-hydroxyethyl, 2-cyanoethyl, methoxycarbonylmethyl, etc.; a cycloalkyl group having from about 5 to about 7 carbon atoms, such as cyclohexyl, cyclopentyl, etc.; an aryl group having from about 6 to about 10 carbon atoms, such as phenyl, pyridyl, naphthyl, p-tolyl, p-chlorophenyl, m-(N-methyl sulfamoyl)-phenyl; or a dialkylamino group, such as dimethylamino, morpholino or pyrrolidino;

$R^6$ and $R^7$ each independently represents a substituted or unsubstituted alkyl group having from 1 to about 10 carbon atoms, such as methyl, ethyl, propyl, isopropyl, butyl, pentyl, hexyl, methoxyethyl, benzyl, 2-methanesulfonamidoethyl, 2-hydroxyethyl, 2-cyanoethyl, methoxycarbonylmethyl, etc.; a cycloalkyl group having from about 5 to about 7 carbon atoms, such as cyclohexyl, cyclopentyl, etc.; or an aryl group having from about 6 to about 10 carbon atoms, such as phenyl, pyridyl, naphthyl, p-tolyl, p-chlorophenyl, or m-(N-methyl sulfamoyl)phenyl; or $R^6$ and $R^7$ may be joined together to form, along with the nitrogen to which they are attached, a 5- or 6-membered heterocyclic ring, such as a pyrrolidine or morpholine ring; and Z represents hydrogen or the atoms necessary to complete a 5- or 6-membered ring, thus forming a fused ring system such as naphthalene, quinoline, isoquinoline or benzothiazole.

In a preferred embodiment of the invention, $R^1$ is phenyl; $R^2$ is ethoxy or $NHR^6$, wherein $R^6$ is methyl or phenyl; and $R^5$ is hydrogen.

In another preferred embodiment, $R^2$ is O and completes a 6-membered ring fused to the benzene ring. In another preferred embodiment, $R^2$ is $NR^6R^7$, wherein each $R^6$ and $R^7$ is methyl or $R^6$ is ethyl and $R^7$ is phenyl. In another preferred embodiment, $R^2$ is $NR^6R^7$, wherein $R^6$ and $R^7$ are joined together to form, along with the nitrogen to which they are attached, a pyrrolidine or morpholine ring.

In still another preferred embodiment, $R^3$ is methyl, ethyl or butyl and $R^4$ is methyl, ethyl, butyl or $CO_2CH_2CF_3$.

In yet still another preferred embodiment, $R^3$ and $R^4$ are joined together to form a pyrrolidine ring.

The above dyes are generally all of yellow hue.

The aromatic ring in the formula above may be substituted with various substituents, such as $C_1$ to $C_6$ alkyl, $C_1$ to $C_6$ alkoxy, halogen, sulfonamido, aryloxy, acyloxy, acylamido, etc.

Compounds included within the scope of the invention include the following:

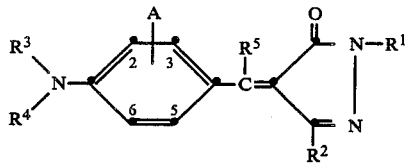

| Cmpd. | A | $R^3$ | $R^4$ | $R^5$ | $R^2$ | $R^1$ |
|---|---|---|---|---|---|---|
| 1 | H | $C_2H_5$ | $C_2H_5$ | H | $N(CH_3)_2$ | $C_6H_5$ |
| 2 | H | $CH_3$ | $CH_3$ | H | $N(CH_3)_2$ | $C_6H_5$ |
| 3 | H | n-$C_4H_9$ | n-$C_4H_9$ | H | $N(CH_3)_2$ | $C_6H_5$ |
| 4 | 3-$CH_3$ | $C_2H_5$ | $CF_3CH_2O_2CCH_2$ | H | $N(CH_3)_2$ | $C_6H_5$ |
| 5 | H | 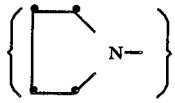 | | H | $N(CH_3)_2$ | $C_6H_5$ |
| 6 | H | $C_2H_5$ | $C_2H_5$ | H | $NHC_6H_5$ | $C_6H_5$ |
| 7 | H | $C_2H_5$ | $C_2H_5$ | H | 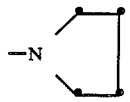 | $C_6H_5$ |
| 8 | H | $C_2H_5$ | $C_2H_5$ | H | 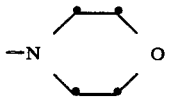 | $C_6H_5$ |
| 9 | H | $C_2H_5$ | $C_2H_5$ | H | $NHCH_3$ | $C_6H_5$ |
| 10 | H | $C_2H_5$ | $C_2H_5$ | H | $N(C_2H_5)(C_6H_5)$ | $C_6H_5$ |
| 11 | 3-$OCH_3$ | $C_2H_5$ | $C_2H_5$ | H | $NCH_3CH_3$ | $C_6H_5$ |
| 12 | H | n-$C_4H_9$ | n-$C_4H_9$ | H | $OC_2H_5$ | $C_6H_5$ |
| 13 | 3-Cl | $CH_3$ | $C_2H_5O_2CCH_2$ | H | $N(CH_3)_2$ | $C_{10}H_9$ |
| 14 | H | 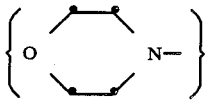 | | H | $OCH_3$ | p-Cl—$C_6H_4$ |
| 15 | 3-$CH_3$ | $ClC_2H_4$ | $ClC_2H_4$ | H | $OC_6H_5$ | $CH_2C_6H_5$ |
| 16 | 3-$C_2H_5$ | $C_6H_5CH_2$ | $C_2H_5$ | H | $N(CH_3)_2$ | $CH_3$ |
| 17 | 2,5-($OCH_3$) | $CH_3$ | $CH_3$ | H | $NHCH_3$ | 3,5(Cl)—$C_6H_3$ |
| 18 | H | $CH_3$ | $CH_3$ | $CO_2C_2H_5$ | $N(CH_3)_2$ | $C_6H_5$ |
| 19 | H | $CH_3$ | $CH_3$ | Cl | $N(CH_3)_2$ | $C_6H_5$ |

20

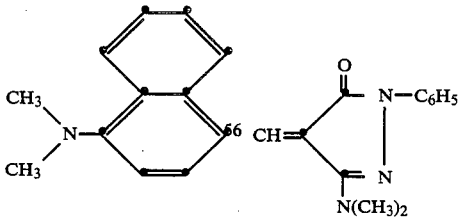

-continued

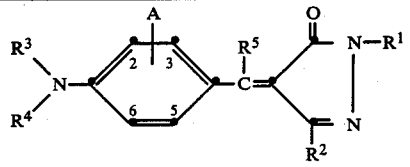

| Cmpd. | A | $R^3$ | $R^4$ | $R^5$ | $R^2$ | $R^1$ |
|---|---|---|---|---|---|---|
| 21 | 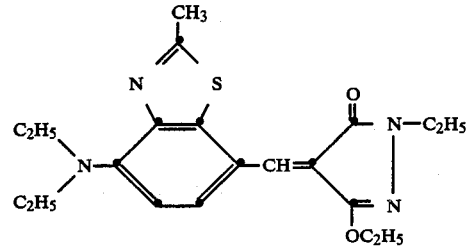 | | | | | |
| 22 | 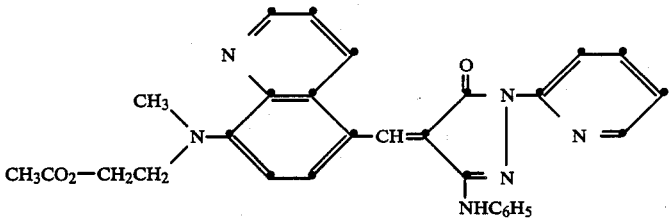 | | | | | |
| 23 | 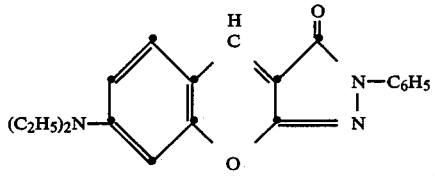 | | | | | |

These dyes may be prepared using synthetic techniques similar to those disclosed in J. Indian Chem. Soc., 57, 1108 (1980), the disclosure of which is hereby incorporated by reference.

A dye-barrier layer may be employed in the dye-donor elements of the invention to improve the density of the transferred dye. Such dye-barrier layer materials include hydrophilic materials such as those described and claimed in U.S. Pat. No. 4,716,144 by Vanier, Lum and Bowman.

The dye in the dye-donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207 of Vanier and Lum; a polycarbonate; poly(styrene-co-acrylonitrile), a poly(sulfone) or a poly(phenylene oxide). The binder may be used at a coverage of from about 0.1 to about 5 $g/m^2$.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluororethylene-co-hexafluoropropylene); polyethers such as polyoxymethylene; polyacetals; polyolefins such as polystyrene, polyethylene, polypropylene or methylpentane polymers; and polyimides such as polyimide-amides and polyetherimides. The support generally has a thickness of from about 2 to about 30 μm. It may also be coated with a subbing layer, if desired, such as those materials described in U.S. Pat. No. 4,695,288 of Ducharme or U.S. Pat. No. 4,737,486 of Henzel.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), carbowax, poly(ethylene glycols), or any of those materials disclosed in U.S. Pat. Nos. 4,717,711 of Vanier, Harrison and Kan; 4,717,712 of Harrison, Vanier and Kan; 4,737,485 of Henzel, Lum and Vanier; and 4,738,950 of Vanier and Evans. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

The dye-receiving element that is used with the dye-donor element of the invention usually comprises a support having thereon a dye image-receiving layer. The support may be a transparent film such as poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek®.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only the dye thereon as described above or may have alternating areas of other different dyes, such as sublimable cyan and/or magenta and/or yellow and/or black or other dyes. Such dyes are disclosed in U.S. Pat. Nos. 4,541,830; 4,698,651 of Moore, Weaver and Lum; 4,695,287 of Evans and Lum; 4,701,439 of Weaver, Moore and Lum; 4,757,046 of Byers and Chapman; 4,743,582 of Evans and Weber; 4,769,360 of Evans and Weber; and 4,753,922 of Byers, Chapman and McManus, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of magenta, cyan and a dye as described above of yellow hue, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

Example 1—Yellow Dye-Donor

A yellow dye-donor element was prepared by coating the following layers in the order recited on a 6 μm poly(ethylene terephthalate) support:

(1) Subbing layer of duPont Tyzor TBT® titanium tetra-n-butoxide (0.16 g/m$^2$) coated from n-butyl alcohol, and (2) Dye layer containing the yellow dye identified in Table 1 below (0.36 mmoles/m$^2$), FC-431® surfactant (3M Corp.) (0.002 g/m$^2$), in a cellulose acetate-propionate (2.5% acetyl, 48% propionyl) binder (weight equal to 2.6× that of the dye) coated from a cyclopentanone, toluene, and methanol solvent mixture.

A slipping layer was coated on the back side of the element similar to that disclosed in U.S. Pat. No. 4,738,950 of Vanier et al.

A dye-receiving element was prepared by coating a solution of Makrolon 5705® (Bayer AG Corporation) polycarbonate resin (2.9 g/m$^2$ in a methylene chloride and trichloroethylene solvent mixture on an ICI Melinex 990® white polyester support.

The dye side of the dye-donor element strip 1 inch (2.5 mm) wide was placed in contact with the dye image-receiving layer of the dye-receiver element of the same width. The assemblage was fastened in the jaws of a stepper motor driven pulling device. The assemblage was laid on top of a 0.55 (14 mm) diameter rubber roller and a TDK Thermal Head (No. L-133) and was pressed with a spring at a force of 8.0 pounds (3.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were pulse-heated at increments from 0 up to 8 msec to generate a graduated-density image. The voltage supplied to the print head was approximately 22 v representing approximately 1.5 watts/dot (12 mjoules/dot) for maximum power.

The dye-receiving element was separated from the dye-donor element. The Status A blue reflection densities of each stepped image consisting of a series of 8 graduated density steps 1 cm×1 cm were read. The images were then subjected to High-Intensity Daylight fading (HID-fading) for 7 days, 50 kLux, 5400° K., 32° C., approximately 25% RH and the densities were reread. The percent density loss was calculated from step 7. The following results were obtained:

TABLE 1

| Dye-Donor Element w/ Compound | $\lambda_{max}$ (nm) | Status A Blue Density Init. Dens. | % Loss After Fade |
|---|---|---|---|
| 1 | 447 | 2.4 | 3 |
| 2 | 444 | 2.4 | 5 |
| 3 | 451 | 2.4 | 8 |
| 4 | 445 | 1.7 | 1 |
| 5 | 451 | 2.5 | 6 |
| 6 | 458 | 1.9 | 16 |
| 7 | 447 | 2.3 | 23 |
| 8 | 451 | 2.3 | 3 |
| 9 | 445 | 2.3 | 4 |
| 10 | 462 | 2.0 | 8 |
| 11 | 458 | 2.3 | 4 |
| 12 | 446 | 2.4 | 8 |
| Control 1 | 471 | 1.9 | 66 |
| Control 2 | 457 | 2.1 | 41 |
| Control 3 | 428 | 1.3 | 85 |
| Control 4 | 484 | 1.4 | 77 |
| Control 5 | 434 | 1.6 | 18 |
| Control 6 | 447 | 1.9 | 15 |

The above results indicate that the dyes according to the invention have substantially improved light stability (lower % fade) in comparison to Control dyes 1–4 and improved light stability and/or hue (λ max closer to 450) in comparison to Control dye 5. While Control Dye 6 has good light stability in this test, see Example 2.

Control Compounds

Control Compound 1

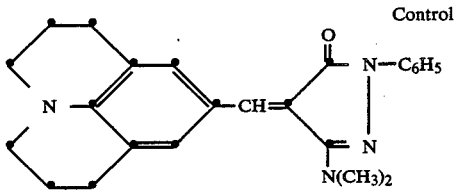

Control Compound 2

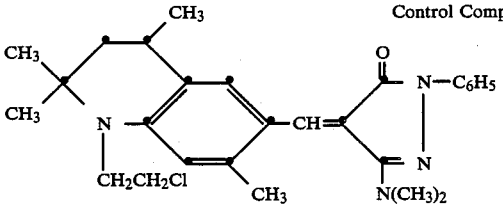

Control Compound 3

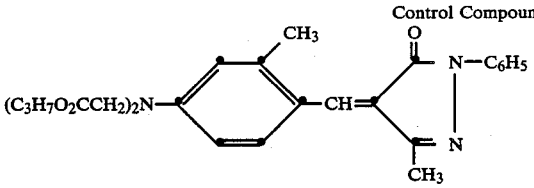

Control Compound 4

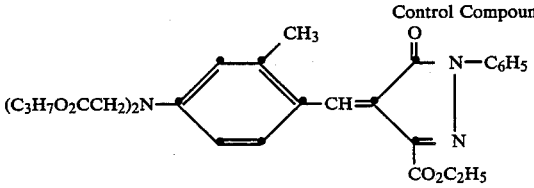

-continued

Control Compound 5

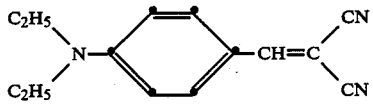

Disclosed in JP 59/78895.

Control Compound 6

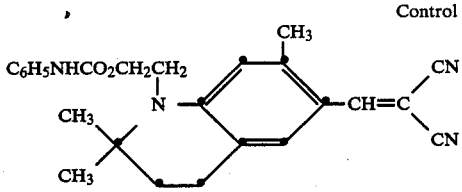

Disclosed in U.S. Pat. No. 4,701,439.

Example 2—Yellow and Cyan Donors

Example 1 was repeated except that a cyan dye-donor element was also prepared using cyan dye 1 from U.S. Pat. No. 4,695,287 at a concentration of 0.78 mmoles/m$^2$.

The printing was the same as in Example 1 except that sequential transfers were obtained using the yellow dye-donors of Example 1 and the cyan dye-donor described above to obtain a green image. Status A blue and red densities of the green image were read. The images were subjected to HID-fading as in Example 1 and reread. The percent density loss for each dye was calculated from the maximum density step. The following results were obtained.

TABLE 2

| Dye-Donor Element w/ Compound | Cyan - Yellow Interactions Red D-Max | Red % Loss After Fade | Blue D-Max | Blue % Loss After Fade |
|---|---|---|---|---|
| 1 | 2.0 | 3 | 2.3 | 1 |
| 2 | 2.1 | 2 | 2.2 | 1 |
| 3 | 2.0 | 3 | 2.3 | 3 |
| 4 | 2.1 | 3 | 1.6 | 1 |
| 5 | 1.9 | 3 | 2.2 | 4 |
| 6 | 2.0 | 3 | 1.9 | 1 |
| 7 | 2.2 | 3 | 2.1 | 2 |
| 8 | 2.1 | 3 | 2.1 | 1 |
| 9 | 2.0 | 3 | 2.1 | 1 |
| 10 | 2.0 | 4 | 1.9 | 1 |
| 11 | 2.0 | 3 | 2.2 | 2 |
| 12 | 2.1 | 8 | 1.5 | 6 |
| Control 5 | 1.8 | 32 | 1.7 | 10 |
| Control 6 | 1.5 | 36 | 1.5 | 15 |

The above results indicate that the compounds of the invention cause significantly less degradation of the cyan dye than the control compounds.

Example 3—Yellow Dye-Donor

A yellow dye-donor element was prepared by coating the following layers in the order recited on a 6 μm poly(ethylene terephthalate) support:

(1) Subbing layer of duPont Tyzor TBT® titanium tetra-n-butoxide (0.16 g/m$^2$) coated from n-butyl alcohol and n-propyl acetate, and (2) Dye layer containing the yellow dyes 18, 19, 20 and 23 identified above (0.47 mmoles/m$^2$), FC-431® surfactant (3M Corp.) (0.002 g/m$^2$), in a cellulose acetate-propionate (2.5% acetyl, 48% propionyl) binder (weight equal to 2.0× that of the dye) coated from a cyclopentanone, toluene, and methanol solvent mixture.

A slipping layer was coated on the back side of the element similar to that disclosed in U.S. application Ser. No. 184,316 of Henzel et al, filed April 21, 1988.

A dye-receiving element was prepared by coating a solution of Makrolon 5705® (Bayer AG Corporation) polycarbonate resin (2.9 g/m$^2$) and polycaprolactone (0.8 g/m$^2$) in methylene chloride on a pigmented polyethylene-overcoated paper stock.

The dye side of the dye-donor element strip approximately 10 cm×13 cm in area was placed in contact with the dye image-receiving layer of the dye-receiver element of the same area. The assemblage was clamped to a stepper-motor driven 60 mm diameter rubber roller and a TDK Thermal Head (No. L-231) (thermostatted at 26° C.) was pressed with a force of 8.0 pounds (3.6 kg) against the dye-donor element side of the assemblage pushing it against the rubber roller.

The imaging electronics were activated causing the donor/receiver assemblage to be drawn between the printing head and roller at 6.9 mm/sec. Coincidentally, the resistive elements in the thermal print head were pulsed at 29 μsec/pulse at 128 μsec intervals during the 33 msec/dot printing time. A stepped density image was generated by incrementally increasing the number of pulses/dot from 0 to 255. The voltage supplied to the print head was approximately 23.5 volts, resulting in an instantaneous peak power of 1.3 watts/dot and a maximum total energy of 9.6 mjoules/dot.

The dye-receiving element was separated from the dye-donor element. A status A blue reflection densities of each stepped image consisting of a series of 11 graduated density steps 1 cm×1 cm were read.

The images were then subjected to High-Intensity Daylight fading (HID-fading) for 7 days, 50 kLux, 5400° K., 32° C., approximately 25% RH and the densities were reread. The percent density loss was calculated from a step with an initial density of approximately 1.0. The λ-max of each dye in an acetone solution was also determined. The following results were obtained:

TABLE 3

| Dye-Donor Element w/ Compound | Fade Test (days) | $\lambda_{max}$ | Status A Blue Density % Loss After Fade |
|---|---|---|---|
| 18 | 7 | 459 | 10 |
| 19 | 7 | 456 | 30 |
| 20 | 7 | 447 | 25 |
| 23 | 7 | 432 | 4 |
| Control 5 | 7 | 434 | 63 |
| Control 6 | 7 | 447 | 43 |
| Control 7 | 7 | 439 | 46 |

The above results indicate that the yellow dyes according to the invention has improved light stability in comparison to various control yellow dyes.

Control Compound 7

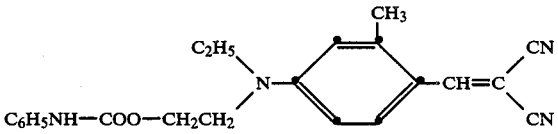

[Artisil Foron 6GFL® (Sandoz Corp.)]

The invention has been described in detail with particular reference to preferred embodiments thereof, but it will be understood that variations and modifications can be effected within the spirit and scope of the invention.

What is claimed is:

1. A dye-donor element for thermal dye transfer comprising a support having thereon a dye dispersed in a polymeric binder, said dye having the formula:

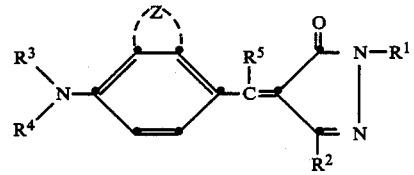

wherein $R^1$ represents a substituted or unsubstituted alkyl group having from 1 to about 10 carbon atoms; a cycloalkyl group having from about 5 to about 7 carbon atoms or an aryl group having from about 6 to about 10 carbon atoms;

$R^2$ represents a substituted or unsubstituted alkoxy group having from 1 to about 10 carbon atoms; a substituted or unsubstituted aryloxy group having from about 6 to about 10 carbon atoms; $NHR^6$; $NR^6R^7$ or the atoms necessary to complete a 6-membered ring fused to the benzene ring;

$R^3$ and $R^4$ each represents $R^1$; or $R^3$ and $R^4$ can be joined together to form, along with the nitrogen to which they are attached, a 5- or 6-membered hetercyclic ring;

$R^5$ represents hydrogen; halogen; carbamoyl; alkoxycarbonyl; acyl; a substituted or unsubstituted alkyl or alkoxy group having from 1 to about 10 carbon atoms; a cycloalkyl group having from about 5 to about 7 carbon atoms; an aryl group having from about 6 to about 10 carbon atoms; or a dialkylamino group;

$R^6$ and $R^7$ each independently represents a substituted or unsubstituted alkyl group having from 1 to about 10 carbon atoms; a cycloalkyl group having from about 5 to about 7 carbon atoms or an aryl group having from about 6 to about 10 carbon atoms; $R^6$ and $R^7$ may be joined together to form, along with the nitrogen to which they are attached, a 5- or 6-membered heterocyclic ring; and Z represents hydrogen or the atoms necessary to complete a 5- or 6-membered ring.

2. The element of claim 1 wherein $R^1$ is phenyl; $R^2$ is ethoxy or $NHR^6$, wherein $R^6$ is methyl or phenyl; and $R^5$ is hydrogen.

3. The element of claim 1 wherein $R^2$ is O and completes a 6-membered ring fused to the benzene ring.

4. The element of claim 1 wherein $R^2$ is $NR^6R^7$, wherein each $R^6$ and $R^7$ is methyl or $R^6$ is ethyl and $R^7$ is phenyl.

5. The element of claim 1 wherein $R^2$ is $NR^6R^7$, wherein $R^6$ and $R^7$ are joined together to form, along with the nitrogen to which they are attached, a pyrrolidine or morpholine ring.

6. The element of claim 1 wherein $R^3$ is methyl, ethyl or butyl and $R^4$ is methyl, ethyl, butyl or $CO_2CH_2CF_3$.

7. The element of claim 1 wherein $R^3$ and $R^4$ are joined together to form a pyrrolidine ring.

8. The element of claim 1 wherein the dye is of yellow hue.

9. The element of claim 1 wherein said support comprises poly(ethylene terephthalate) and the side of the support opposite the side having thereon said dye layer is coated with a slipping layer comprising a lubricating material.

10. The element of claim 1 wherein said dye layer comprises sequential repeating areas of magenta, cyan and said dye which is of yellow hue.

11. In a process of forming a dye transfer image comprising imagewise-heating a dye-donor element comprising a support having thereon a dye layer comprising a dye dispersed in a polymeric binder and transferring a dye image to a dye-receiving element to form said dye transfer image, the improvement wherein said dye has the formula:

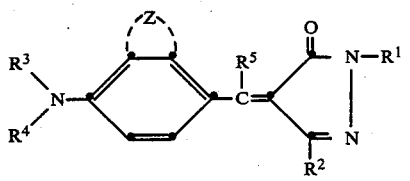

wherein $R^1$ represents a substituted or unsubstituted alkyl group having from 1 to about 10 carbon atoms; a cycloalkyl group having from about 5 to about 7 carbon atoms or an aryl group having from about 6 to about 10 carbon atoms;

$R^2$ represents a substituted or unsubstituted alkoxy group having from 1 to about 10 carbon atoms; a substituted or unsubstituted aryloxy group having from about 6 to about 10 carbon atoms; $NHR^6$; $NR^6R^7$ or the atoms necessary to complete a 6-membered ring fused to the benzene ring;

$R^3$ and $R^4$ each represents $R^1$; or $R^3$ and $R^4$ can be joined together to form, along with the nitrogen to which they are attached, a 5- or 6-membered hetercyclic ring;

$R^5$ represents hydrogen; halogen; carbamoyl; alkoxycarbonyl; acyl; a substituted or unsubstituted alkyl or alkoxy group having from 1 to about 10 carbon atoms; a cycloalkyl group having from about 5 to about 7 carbon atoms; an aryl group having from about 6 to about 10 carbon atoms; or a dialkylamino group;

$R^6$ and $R^7$ each independently represents a substituted or unsubstituted alkyl group having from 1 to about 10 carbon atoms; a cycloalkyl group having from about 5 to about 7 carbon atoms or an aryl group having from about 6 to about 10 carbon atoms; $R^6$ and $R^7$ may be joined together to form, along with the nitrogen to which they are attached, a 5- or 6-membered heterocyclic ring; and Z represents hydrogen or the atoms necessary to complete a 5- or 6-membered ring.

12. The process of claim 11 wherein said support is poly(ethylene terephthalate) which is coated with sequential repeating areas of magenta, cyan and said dye which is of yellow hue, and said process steps are sequentially performed for each color to obtain a three-color dye transfer image.

13. In a thermal dye transfer assemblage comprising:

(a) a dye-donor element comprising a support having thereon a dye layer comprising a dye dispersed in a polymeric binder, and (b) a dye-receiving element comprising a support having thereon a dye image-receiving layer, said dye-receiving element being in a superposed relationship with said dye-donor element so that said dye layer is in contact with said dye image-receiving layer, the improvement wherein said dye has the formula:

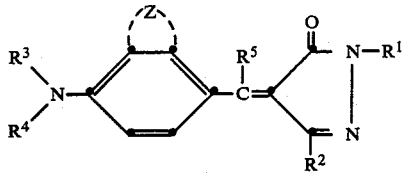

wherein $R^1$ represents a substituted or unsubstituted alkyl group having from 1 to about 10 carbon atoms; a cycloalkyl group having from about 5 to about 7 carbon atoms or an aryl group having from about 6 to about 10 carbon atoms;

$R^2$ represents a substituted or unsubstituted alkoxy group having from 1 to about 10 carbon atoms; a substituted or unsubstituted aryloxy group having from about 6 to about 10 carbon atoms; $NHR^6$; $NR^6R^7$ or the atoms necessary to complete a 6-membered ring fused to the benzene ring;

$R^3$ and $R^4$ each represents $R^1$; or $R^3$ and $R^4$ can be joined together to form, along with the nitrogen to which they are attached, a 5- or 6-membered hetercyclic ring;

$R^5$ represents hydrogen; halogen; carbamoyl; alkoxycarbonyl; acyl; a substituted or unsubstituted alkyl or alkoxy group having from 1 to about 10 carbon atoms; a cycloalkyl group having from about 5 to about 7 carbon atoms; an aryl group having from about 6 to about 10 carbon atoms; or a dialkylamino group;

$R^6$ and $R^7$ each independently represents a substituted or unsubstituted alkyl group having from 1 to about 10 carbon atoms; a cycloalkyl group having from about 5 to about 7 carbon atoms or an aryl group having from about 6 to about 10 carbon atoms; $R^6$ and $R^7$ may be joined together to form, along with the nitrogen to which they are attached, a 5- or 6-membered heterocyclic ring; and Z represents hydrogen or the atoms necessary to complete a 5- or 6-membered ring.

14. The assemblage of claim 13 wherein $R^1$ is phenyl; $R^2$ is ethoxy or $NHR^6$, wherein $R^6$ is methyl or phenyl; and $R^5$ is hydrogen.

15. The assemblage of claim 13 wherein $R^2$ is O and completes a 6-membered ring fused to the benzene ring.

16. The assemblage of claim 13 wherein $R^2$ is $NR^6R^7$, wherein each $R^6$ and $R^7$ is methyl or $R^6$ is ethyl and $R^7$ is phenyl.

17. The assemblage of claim 13 wherein $R^2$ is $NR^6R^7$, wherein $R^6$ and $R^7$ are joined together to form, along with the nitrogen to which they are attached, a pyrrolidine or morpholine ring.

18. The assemblage of claim 13 wherein $R^3$ is methyl, ethyl or butyl and $R^4$ is methyl, ethyl, butyl or $CO_2CH_2CF_3$.

19. The assemblage of claim 13 wherein $R^3$ and $R^4$ are joined together to form a pyrrolidine ring.

20. The assemblage of claim 13 wherein said dye is of yellow hue.

* * * * *